US006910647B2

(12) United States Patent
Alford et al.

(10) Patent No.: US 6,910,647 B2
(45) Date of Patent: Jun. 28, 2005

(54) SIDE REMOVAL SCREEN SYSTEM FOR MATERIALS REDUCING MACHINES

(75) Inventors: Peter B. Alford, Eugene, OR (US); Arnold Neil Peterson, Eugene, OR (US)

(73) Assignee: Peterson Pacific Corporation, Eugene, OR (US)

( * ) Notice: Subject to any disclaimer, the term of this patent is extended or adjusted under 35 U.S.C. 154(b) by 126 days.

(21) Appl. No.: 10/225,714

(22) Filed: Aug. 21, 2002

(65) Prior Publication Data

US 2003/0057306 A1 Mar. 27, 2003

Related U.S. Application Data

(60) Provisional application No. 60/314,090, filed on Aug. 21, 2001.

(51) Int. Cl.[7] ..... B02C 23/16

(52) U.S. Cl. ..... 241/73; 241/285.2; 241/32; 29/426.1

(58) Field of Search ..... 29/426.1, 426.3, 29/428; 241/73, 189.1, 285.1, 285.2, 285.3, 32

(56) References Cited

U.S. PATENT DOCUMENTS

| | | | | |
|---|---|---|---|---|
| 4,151,960 | A | 5/1979 | Peterson, Jr. | |
| 4,706,898 | A | 11/1987 | Schonfeld et al. | |
| 5,911,372 | A | 6/1999 | Williams, Jr. | |
| 2002/0056773 | A1 * | 5/2002 | Zehr | 241/73 |

FOREIGN PATENT DOCUMENTS

| | | | |
|---|---|---|---|
| FR | 1523013 | * | 3/1968 |
| GB | 2144342 A | * | 3/1985 |

* cited by examiner

*Primary Examiner*—Mark Rosenbaum
(74) *Attorney, Agent, or Firm*—Schwabe, Williamson & Wyatt, P.C.

(57) ABSTRACT

The present invention relates to an apparatus and method for removing material sizing and sorting screens from a materials reducing machine. The invention pertains to providing cut outs in the side of the materials reducing machine and positioning the rotor bearing housing to allow access to and the ability to remove screens from the side of the materials reducing machine. Once outside the machine, the screens can be replaced with new screens, rotated, or interchanged with other screens in the materials reducing machine.

11 Claims, 4 Drawing Sheets

SIDE REMOVAL SCREEN SYSTEM FOR MATERIALS REDUCING MACHINES

RELATED APPLICATIONS

This application claims the benefit of U.S. Provisional Application No. 60/314,090, filed Aug. 21, 2001.

FIELD OF THE INVENTION

This invention pertains to apparatus and methods for screening debris from a materials reducing machine. In particular, this invention covers a product sizing screen set-up which can be removed from the side of the machine, easily interchanged, reversed or manipulated by an individual without undue expenditure of time and effort.

BACKGROUND OF INVENTION

Waste recyclers, or materials reducing machines are used to size reduce larger materials, such as wood debris from collection yards, land clearing or demolition-type activities. An example of one such materials reducing machine can be seen in U.S. Pat. No. 5,947,395 entitled Materials Reducing Machine. Generally, waste recycling machines consist of a large rotor that contains knives or hammer teeth spaced along the surface of the rotor. Material to be size reduced is fed into the machine. The teeth of the rotating rotor strike the incoming material, thereby chipping and shredding the debris into smaller sizes. The rotating rotor also advances the debris toward an anvil. The anvil is positioned such that the material hits the anvil, where the material is further reduced by a shearing action between the hammer teeth and the anvil. As the size reduced material passes the anvil it comes in contact with a series of screens or grates which are sized to permit only a desired size of material to pass and discharge from the machine.

The screen pattern and size of the holes can vary. For example, screens can have holes that are round, octagonal, square, etc. as well as varying diameters depending on the ultimate size of the end product desired by the user. Although the bulk of the material is reduced prior to engaging the screens, the screens can further act as a size reducer. In such a case, as the rotor advances the size reduced material past the screens the material gets further reduced by the hammer teeth grating material along the screen hole pattern, thereby shredding and further reducing the material, and forcing it out the screen holes. Often the need arises to change these screens. One reason to change the screens might be that the screen has been used long enough such that the bottom edges of the holes have dulled to the point that they are no longer effective in size reducing and screening the material. Screens may also need to be changed if the operator of the waste recycler desires a different product, which includes screening the material by a different size. In such cases the screens must be removed from the machine and replaced.

The screens are typically made of a heavy-duty material, such as steel, and are often extremely large, heavy and awkward to manipulate. To remove and replace a screen in current materials reducing machines, typically one or more individuals must completely disengage the machine and gain access to the screens through the top front portion of the machine. Access to the screens is obtained by pivoting what is known as the anvil housing upward such that the rotor is exposed and the screens surrounding the rotor can be removed. Typically, one screen, which is held into place by the anvil housing will be relatively accessible once the machine is open and the anvil housing is disengaged. The other screens, however, are more difficult to access as they must be slid up from toward the bottom of the rotor to the access opening created by the disengagement of the anvil housing, either by the operator's brut force, or by using some sort of mechanical assistance for sliding or rotating the screen up towards the access location. Further, the screens take a substantial amount of abuse during operation, which may cause the screens to deform and make removal thereof even more difficult.

Current materials reducing machines have proven to be cumbersome and extremely difficult for an operator to effectively and rapidly manipulate screens in order to change screens depending on product requirements or replace the worn out screens. As such, there exists a need for a materials reducing machine where the screens can be readily changed without significant disassembly and effort to access and remove the screens.

SUMMARY OF INVENTION

The present invention is directed to providing a readily removable and interchangeable screen system for material reducing machines. As described in the background of the invention, screens of current waste recycling machines cannot be removed, replaced or interchanged without significant loss of time and expending significant effort to access and remove the screens.

The enclosed embodiment of the present invention solves the problems associated with prior materials reducing machine screens by designing a machine in which the screens can be accessed and removed from the side of the machine, changed or rotated 180 degrees and replaced through the side of the machine, all without significant machine disassembly and effort by the operators.

DESCRIPTION

In the following detailed description, reference is made to the accompanying drawings which form a part hereof wherein like numerals designate like parts throughout, and which show by way of illustration specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

Figure 1:
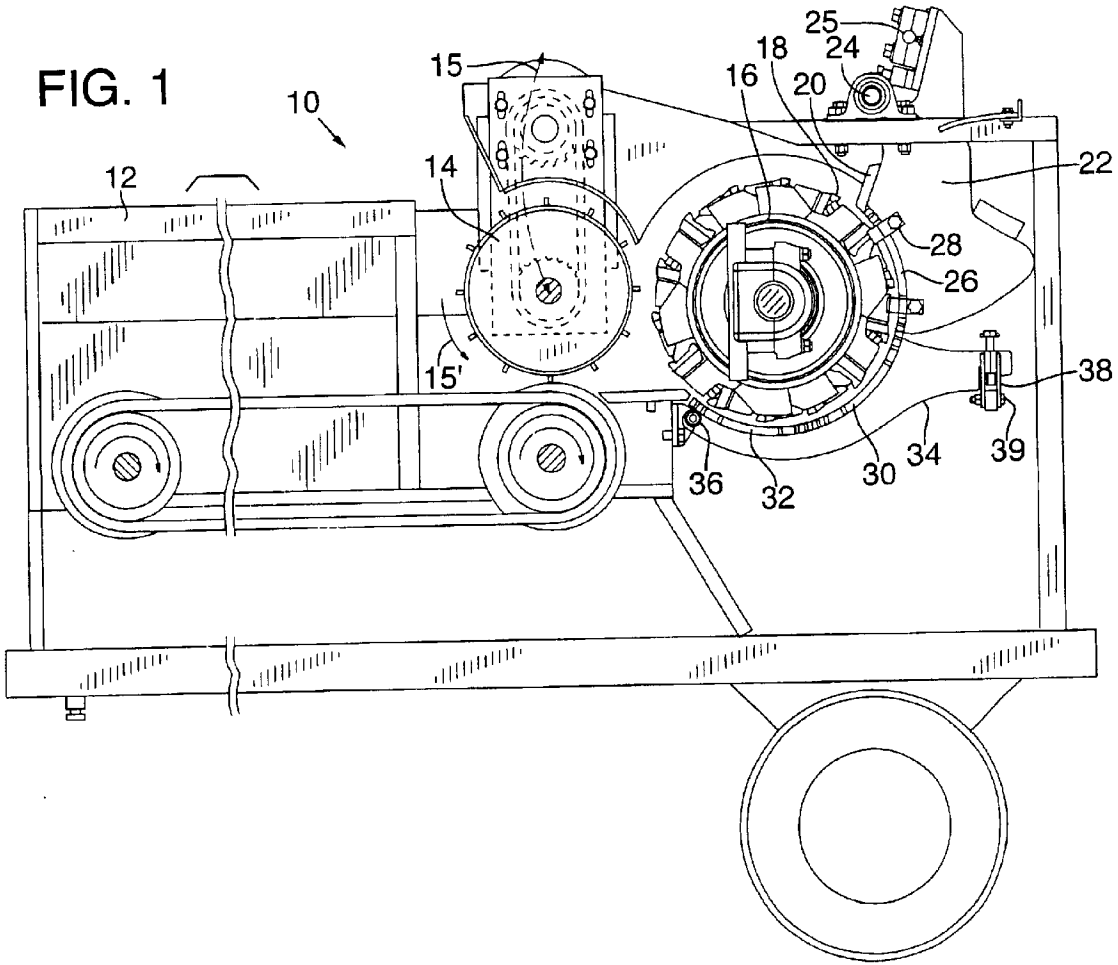
FIG. 1 is a side view of a materials reducing machine.

FIG. 1 illustrates a material reducing machine 10 with the outside walls removed, which is configured to reduce debris such as logs, stumps, limbs, and other materials into smaller sizes. Material reducing machine 10 can either be portable, i.e. on wheels or a trailer, or it may be fixed in a particular location to perform the task of size reducing debris.

In the illustrated embodiment, material to be reduced is fed into machine 10 at receiving bin 12. The material is advanced toward a pivotal 15 and rotating 15' hold down roller 14, which compacts the material and helps propel it into the rotational path of rotor 16. Rotor 16 is a large revolveable drum that has a number of rotor teeth 18 in spaced intervals located around the periphery of the rotor 16. As the rotor teeth 18 strike the material fed from hold down roller 14, the first size reducing of the material occurs, or what is known as the initial breakdown of the material. As the material passes the initial breakdown phase and revolves around rotor 16, it strikes against anvil 20, which is secured to first screen support member 22, which is a pivotable housing upon which supports first screen 26. Anvil 20 is positioned such that as the material hits anvil 20, it is sheared and further reduced in size. This is also known as the secondary breakdown of the material.

The material that passes anvil 20 in the secondary breakdown phase is then ready for final sizing by screens 26, 30 and 32 located around a portion of the periphery of rotor 16. The screen system, which in the illustrated embodiment is made up of three separate screens, 26, 30, and 32, (see FIG. 4 and discussed below) performs a dual function of further size reducing the material and allowing properly sized material to pass through the screens as final product. It can be appreciated by one skilled in the art that the number of screens need not be limited to three, but can be fewer or more depending on the composition of the feed material, machine size, application and desired product size.

First screen 26 does the majority of the material final sizing. Screen 26 is selected so that the hole pattern produces the appropriate sized final product. Though the material is primarily size reduced in the initial breakdown and secondary breakdown phases, material passing anvil 20 may still be too large to pass through the selected screen size of first screen 26. As such, the holes of first screen 26 further size reduces the material by the action of the revolving rotor teeth 18 grating the material against the holes of first screen 26 (see FIG. 4 for a drawing of a screen). This grating action further reduces the size such that it can pass through the holes of first screen 26. The material that passes through the holes of first screen 26 is typically smaller than the hole size. For example, it has been found that the product passing through screens having a pattern of one inch diameter holes will be ¼ inch and smaller in size.

Material that is further reduced by the grating action but does not pass through the holes of first screen 26 can encounter more size reduction and pass through the holes of second screen 30 and third screen 32. It has been found, however, that very little, if any size reduction occurs in the second screen 30 and third screen 32. As such, it is often desirable to select the hole pattern and size of second screen 30 and third screen 32 to be slightly larger than the hole pattern size of first screen 26, as the material will be adequately size reduced and no further size reduction need take place. However, if an extremely fine product is desired, selecting a smaller hole pattern for second screen 30 and third screen 32 would be advantageous.

First screen 26 is removably attached to first screen support member 22 through screen clamps 28. First screen support member 22 pivots about pin 24 such that in the closed or operational position, the first screen 26 is in position to screen material and perform final sizing of the material (as is the position illustrated in FIG. 1). First screen support member 22 or which is sometimes referred to as an anvil housing is maintained in the operational configuration through the use of shear pin mechanism 25, which will shear and allow first screen support member 22 and first screen 26 to move to a disengaged position if an ungrindable object is encountered.

To change first screen 26, due to wear or if a different sized product is desired, first screen support member 22 pivots upward and outward on pivot pin 24. First screen support member 22 can be pivoted manually or by mechanical assistance, such as a hydraulic cylinder and mechanical linkage. Screen clamps 28 can be removed, which allows first screen 26 to be pulled laterally outward perpendicular to the side of machine 10 and similarly replaced.

Second screen 30 and third screen 32 are held into the closed position by secondary screen support members 34. In the illustrated embodiment, support members 34 are retaining bars that are sized to cradle the curved screens 30 and 32. To change second screen 30 and/or third screen 32, secondary screen support members 34 is lowered slightly by releasing tensioning mechanism 38. As illustrated, a conventional clevis mechanism is used to raise and lower the secondary screen support members 34 thereby selectively applying and relieving tension. It can be appreciated by one skilled in the art, however, that any device that can selectively apply tension to the secondary screen support members 34 will work without departing from the scope of the invention, including hydraulic arms and the like. As further shown in FIGS. 2 and 3, multiple support members 34 can be used as needed to adequately support screens 30 and 32 along the length of rotor 16.

As shown in FIG. 1, when tensioning mechanism 38 is released, the secondary screen support members 34 pivot about pin 36, thereby releasing tension on screens 30 and 32. Once the tension is relieved, second screen 30 and/or third screen 32 can be slid laterally out the side of machine 10. This alleviates the need to rotate the screens upwardly and out the opening created by first screen support member 22 being in the open or disengaged position, as is required in the current materials reducing machines. As with first screen support member 22, secondary screen support members 34 and tensioning mechanism 38 are maintained in the operational configuration through shear pin mechanism 39, which allows disengagement of second screen 30 and third screen 32 if an ungrindable object is encountered.

Figure 2:
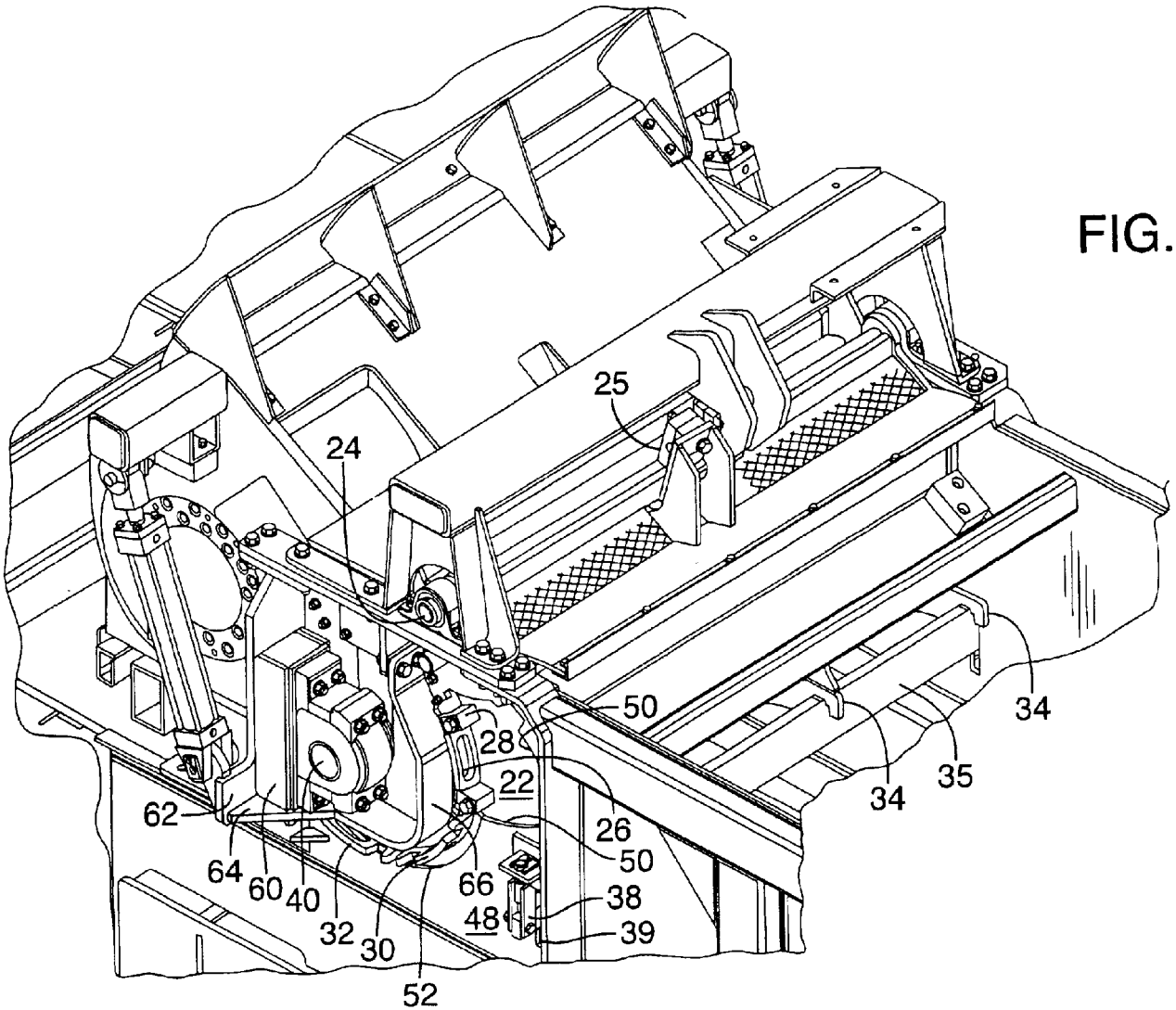
FIG. 2 is a partial perspective view of the materials reducing machine with the screens in the operational configuration.

FIG. 2 is a partial perspective view of the materials reducing machine with screens 26, 30 and 32 in the operation position, and cut outs in side wall 48 of machine 10, which enable side removal. Screens 26, 30 and 32 are sized such that a portion of the screen end protrudes through the sides of machine 10. In the illustrated embodiment, the ends of screens 26,30 and 32 have hand holds 31 (shown in FIG. 4) cut therein to allow an operator to grasp the screens for removal and replacement.

As described above, to remove first screen 26, first screen support member 22 must be pivoted toward the disengaged position. To do so, however, an access port 50 must be cut out of side wall 48 and appropriately sized to accommodate the swing path of the protruding ends of first screen 26. Once in the disengaged position, screen clamps 28 can be removed so that first screen 26 is no longer attached to first screen support member 22. Once clamps 28 are removed, first screen 26 can be pulled out of the machine through the first screen access port 50 in side wall 48.

Figure 4:
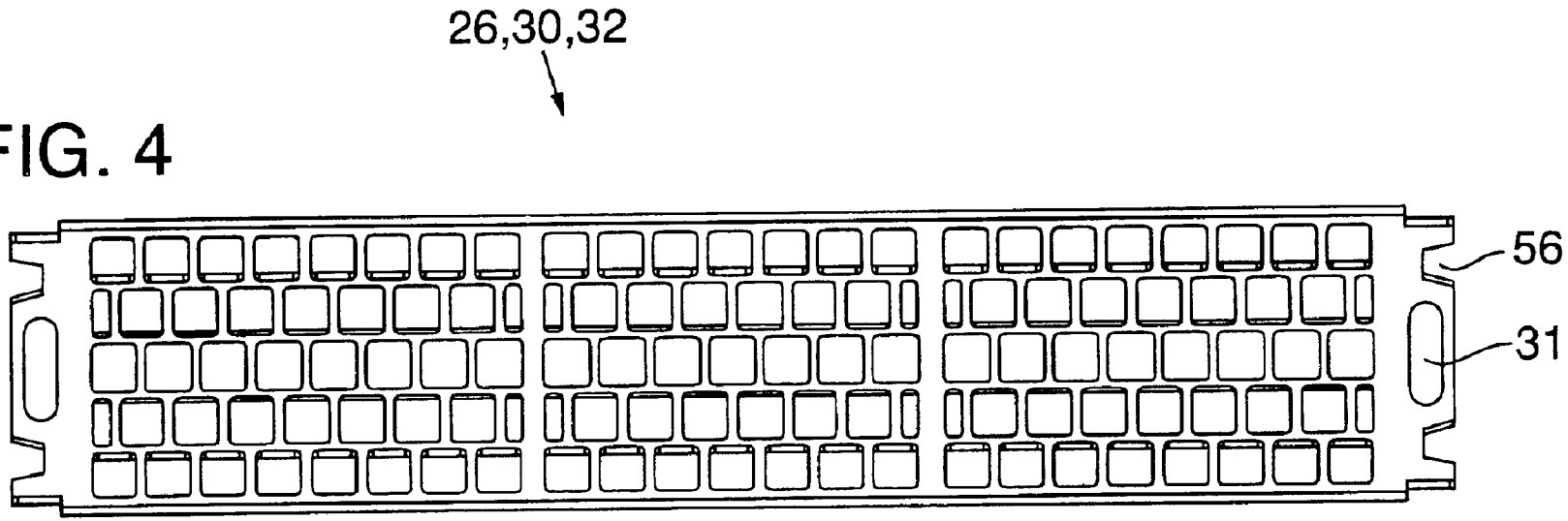
FIG. 4 is a side view of a materials reducing screen.

Referring to FIG. 4, first screen 26, as with second screen 30 and third screen 32, is symmetrical in shape from end to end. As such, first screen 26 can be removed, rotated 180 degrees and reinserted if one side of the holes are worn, or first screen 26 can be removed and replaced with a screen having a hole pattern of a different size and shape to produce a particular product size. Also, second screen 30 and third screen 32, removal of which is discussed below, can be interchanged with each other or with first screen 26. In the illustrated embodiment, hand holds 31 are cut into each end of the screens 26, 30 and 32 to enable an operator to grasp and remove the screens from the side wall 48 of machine 10. As also shown in FIG. 4, clamps 28 as discussed with regard to first screen 26 above engage clamp slot 56, which is tapered to enable a centering effect of the screen when screen clamp 28 engages clamp slot 56.

Referring back to FIG. 2, second screen 30 and third screen 32 are removed through secondary slot 52 in side wall 48. Secondary slot 52 is only slightly larger than the thickness of the screens 30 and 32, as less clearance is required for second screen 30 and third screen 32 to be laterally slid out the side of machine 10. In the operational configuration, secondary screen support members 34 keep second screen 30 and third screen 32 in position by forcing them against the top portion of secondary access port 52 cut out of side wall 48. Tension on the secondary screen support members 34 is regulated by retaining bar tensioning mechanism 38, as discussed above with respect to FIG. 1. As multiple secondary screen support members 34 can be used, a linkage 35 can be used to enable a variety of tensioning mechanisms to raise and lower support members 34. When the operator desires to remove either second screen 30 or third screen 32, the tension on secondary screen support members 34 is relieved and secondary screen support members 34 pivot downwardly on pivot pin 36. Accordingly, second screen 30 and third screen 32 drop downwardly and rest against the bottom side of secondary screen access port 52. Once in the disengaged position, either second screen 30 or third screen 32 can be removed by pulling the selected screen through secondary screen access port 52 in side wall 48. As with the first screen 26, once removed, screens 30 and 32 can be replaced if worn, interchanged with one another, rotated 180 degrees, or can be interchanged with the first screen 26.

Though the illustrated embodiment shows cut outs in side wall 48 creating access ports 50 and 52, one skilled in the art will appreciate that side wall 48 can be removed in order to gain access to screens 26, 30 and 32, whereby they can be removed out the side of machine 10. It is preferred, however, for the side walls 48 to remain in place and the screens 26, 30 and 32 be removed through access ports 50 and 52 to minimize time and effort required to change or rotate screens.

Figure 3:
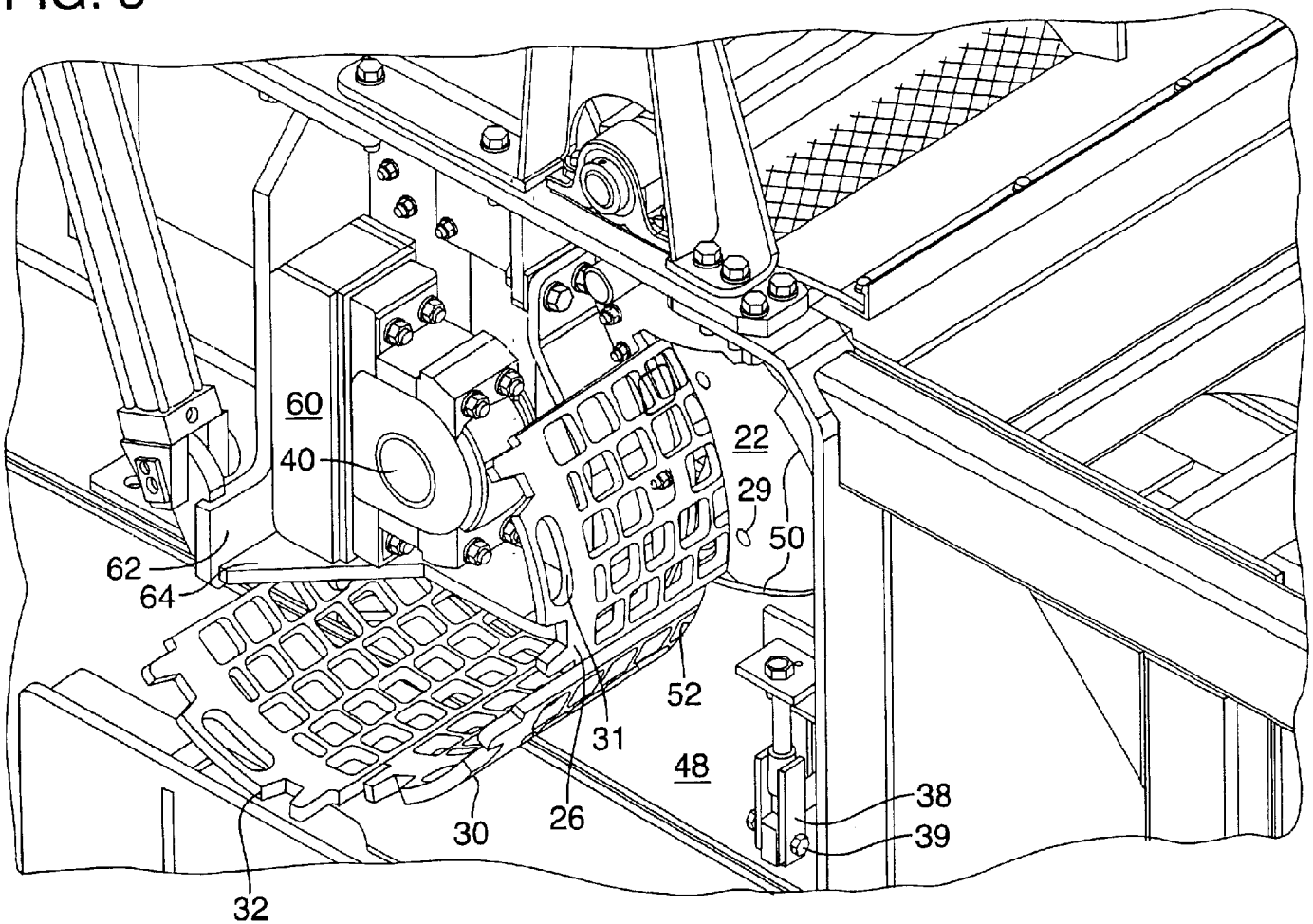
FIG. 3 is a partial perspective view of the materials reducing machine with the screens partially removed.

FIG. 3 shows screens 26, 30 and 32 partially removed from the side of machine 10. In regards to fist screen 26, first screen support member 22 is in the disengaged position, screen clamps 28 (not shown in FIG. 3) are removed from their attachment point 29 on first screen support member 22. First screen 26 is partially pulled out of first screen access port 50 using hand holds 31. For second screen 30 and third screen 32, tensioning mechanism 38 is extended to relieve the tension on secondary screen support members 34 (not shown in FIG. 3). Second screen 30 and third screen 32 can then be pulled out the secondary screen access port 52 in side wall 48 using hand holds 31.

Referring back to FIG. 2, to enable secondary slot 52 and first screen access slot 50 to be cut into the side wall 48, and to provide unobstructed access to screens 30 and 32, rotor bearing housing 40 cannot be traditionally mounted, i.e. with rotor bearing housing support 60 horizontally affixed to the lower portion of machine 10, as is done in current materials reducing machines. To do so blocks access to the screens and prevents side removal. Rather, the mounting assembly for rotor bearing housing 40 must be reconfigured such that rotor bearing housing support 60 is mounted in a way that does not block access to screens 26, 30 and 32.

In the illustrated embodiment, rotor bearing housing support 60 mounts vertically to the side, such that it would not interfere with removal of screens 26, 30 and 32. To provide the necessary support, rotor bearing housing 40 and rotor bearing housing support 60 are supported off to the side by support brackets 62 and 64, which are integral with the side wall 48 of machine 10. Though not illustrated, rotor bearing 40 and rotor bearing housing support 60 can be similarly mounted to the upper side of the materials reducing machine 10 such that access to screens 26, 30 and 32 is unobstructed.

To reinforce side wall 48 with first screen access slot 50 and secondary slot 52 cut out, reinforcement bracket 66 is used. This enables the protruding portion of second screen 30 and third screen 32 to be forced against the top edge of secondary slot 52 by secondary screen support members 34 in the operational configuration, as well as the first screen 26 to be forced against the inside edge of first screen access port 50 by first screen support member 22 in the operational configuration without side wall 48 buckling or deforming. For lighter operations, support bracket 66 may not be necessary.

Those skilled in the art would recognize that though a three screen system is depicted and described, fewer or more screen may be used depending on the operational situation, size of the machine, and nature of the material being size reduced. For larger machines, more screens may be employed in order to keep the weight of each individual screen section to a point that can be maneuvered by an individual (e. g. 100 pounds). It can also be appreciated by one skilled in the art that the described and illustrated support structure for the rotor bearing housing can be number of configurations to provide adequate support for the rotor bearing housing 40 without departing from the spirit of the invention, which includes providing unobstructed access through the side wall 48 of machine 10 to screens 26, 30 and 32.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A materials reducing machine comprising:

a rotor revolvably disposed between two side walls of the materials reducing machine, teeth mounted on the rotor for engaging and size reducing material directed toward the rotor;

at least one curved screen having an operational first position wherein the at least one screen is spaced strategically from the rotor teeth for size reducing and sorting material received from the rotor, and a disengaged second position wherein the at least one screen is spaced from the rotor such that the material is not engaged for size reducing and sorting; and at least one releasable support member for supporting the at least one screen in the first operational configuration, when released the at least one releasable support member allows the at least one screen to go to the disengaged second position, wherein the at least one screen is accessible and removable through a side of the materials reducing machine.

2. The materials reducing machine of claim 1, further comprising the at least one screen having a first end and a second end, and being sized such that it is wider than the width between the side walls; and the side walls having a port cut therein and sized to allow the first end and second end of the at least one screen to protrude therethrough and to accommodate the protruding first and second ends in both the operational first position and the disengaged second position.

3. The materials reducing machine of claim 1, wherein the at least one support member further comprises a pivotable housing having the at least one screen attached thereto by at least one clamp, the pivotable housing holding the screen in the operational first position by a shear pin, release of the shear pin enables the pivotable housing to be rotated to the disengaged second position, whereby the at least one clamp can be released and the at least one screen can be removed through the side of the materials reducing machine.

4. The materials reducing machine of claim 1, wherein the at least one support member further comprises a plurality of releasable retaining bars having the at least one screen disposed there across, the plurality releasable retaining bars being coupled to enable cooperative movement from the operational first position to the disengaged second position.

5. The materials reducing machine of claim 4, further comprising at least one tensioning mechanism coupled to the plurality of retaining bars, the at least one tensioning mechanism having a first position that holds the retention bars in the operational first position and a second position that enables the plurality of retention bars to move toward the disengaged second position, whereby the at least one screen can be removed through the side of the materials reducing machine.

6. The tensioning mechanism of claim 5 wherein a shear pin provides support for the tensioning mechanism such that if an ungrindable object is encountered the shear pin will shear enabling the plurality of retention bars to rotate to the disengaged second position.

7. The materials reducing machine of claim 1, wherein the at least one screen has a first end and a second end, the first end and the second end being symmetrical with one another.

8. The materials reducing machine of claim 1, wherein the at least one screen has a hand hole cut out of the first and second ends, whereby the at least one screen can be grasped for removal.

9. A method for removing screens from a materials reducing machine comprising:

providing a materials reducing machine having a rotatable rotor disposed between two side walls and at least one screen retained in an operational first position by at least one releasable support member, the operational position being such that the at least one screen is strategically positioned in relation to the rotor to allow the screen to size reduce and sort material from the rotor;

releasing the at least one support member;

pivoting the at least one support member and the at least one screen away from the rotor to a disengaged second position; and removing the at least one screen through at least one side wall of the materials reducing machine.

10. The method for removing screens from a materials reducing machine comprising of claim 9, wherein releasing the at least one support member further comprises removing a shear pin that locks the at least one support member in the operational first position.

11. The method for removing screens from a materials reducing machine of claim 9, wherein releasing the at least one support member further comprises releasing a tensioning mechanism that holds the at least one support member in the operational first position.

* * * * *

UNITED STATES PATENT AND TRADEMARK OFFICE

CERTIFICATE OF CORRECTION

PATENT NO. : 6,910,647 B2
APPLICATION NO. : 10/225714
DATED : June 28, 2005
INVENTOR(S) : Alford et al.

It is certified that error appears in the above-identified patent and that said Letters Patent is hereby corrected as shown below:

Column 2
Lines 40-41, "…configuration; and" should read --...configuration;--
Line 43, "...removed." should read --...removed; and--

Column 3
Line 18, "...32, (see..." should read --...32 (see...--

Column 4
Line 14, "...members 34 is..." should read --...members 34 are…--
Lines 46-47, "...31 (shown in FIG. 4)..." should read --...31 (shown in FIGS. 3 and 4)...--.

Column 5
Line 10, "...secondary slot 52..." should read --...secondary screen access port 52...--.
Line 11, "...secondary slot 52..." should read --...secondary screen access port 52...--.
Line 17, "...secondary access port 52..." should read --...secondary screen access port 52...--.
Line 46, "...fist screen 26,..." should read --…first screen 26,...--.
Line 58. "first screen access slot 50 …" should read --first screen access port 50...--.
Line 59, "...secondary slot 52..." should read --...secondary screen access port 52...--.

Column 6
Lines 7-8, "...rotor bearing 40..." should read --...rotor bearing housing 40...--.
Line 11, "...first screen access slot 50" should read --...first screen access port 50--.
Line 12, "...secondary slot 52…" should read --...secondary screen access port 52...--.
Line 15, "secondary slot 52..." should read--...secondary screen access port 52...--.
Line 3G. "...(e. g. 100 pounds)." should read --...(e.g., 100 pounds).--

UNITED STATES PATENT AND TRADEMARK OFFICE

CERTIFICATE OF CORRECTION

PATENT NO. : 6,910,647 B2
APPLICATION NO. : 10/225714
DATED : June 28, 2005
INVENTOR(S) : Alford et al.

It is certified that error appears in the above-identified patent and that said Letters Patent is hereby corrected as shown below:

Column 7
Line 7, "...comprising" should read --...comprising:--.

Signed and Sealed this

Twenty-first Day of November, 2006

JON W. DUDAS
*Director of the United States Patent and Trademark Office*